US006779422B2

(12) United States Patent
Chen

(10) Patent No.: US 6,779,422 B2
(45) Date of Patent: Aug. 24, 2004

(54) RATCHET WRENCH THAT MAY PREVENT JAMMING DURING OPERATION

(76) Inventor: Terence Chen, No. 325, Yunching Rd., Dungshan Shiang, Ilan (TW)

( * ) Notice: Subject to any disclaimer, the term of this patent is extended or adjusted under 35 U.S.C. 154(b) by 5 days.

(21) Appl. No.: 10/254,592

(22) Filed: Sep. 26, 2002

(65) Prior Publication Data

US 2004/0050216 A1 Mar. 18, 2004

(30) Foreign Application Priority Data

Sep. 16, 2002 (TW) ..... 91214691 U

(51) Int. Cl.[7] ..... B25B 13/46
(52) U.S. Cl. ..... 81/60; 81/63; 81/63.2
(58) Field of Search ..... 81/60–63.2; 192/43.1, 192/43.2

(56) References Cited

U.S. PATENT DOCUMENTS 6,446,530 B1 * 9/2002 Chang ..... 81/60
2002/0162424 A1 * 11/2002 Hu ..... 81/60
2003/0019335 A1 * 1/2003 Hu ..... 81/63.2

* cited by examiner

*Primary Examiner*—Debra S. Meislin
(74) *Attorney, Agent, or Firm*—Rosenberg, Klein & Lee

(57) ABSTRACT

A ratchet wrench includes a wrench body, a ratchet wheel, a pawl member, and an elastic member. Thus, when the ratchet wrench jams during operation, the jamming prevention portion may force the pawl member to detach from the ratchet wheel, thereby preventing the ratchet wrench from jamming during operation. In addition, when the pawl member compresses the elastic member to a determined extent, the jamming prevention portion applies a reaction on the wall of the locking recess of the wrench body, so that the pawl member will not compress the elastic member to an excessive extent, thereby preventing from wearing the elastic member.

1 Claim, 5 Drawing Sheets

RATCHET WRENCH THAT MAY PREVENT JAMMING DURING OPERATION

BACKGROUND OF THE INVENTION

1. Field of the Invention

The present invention relates to a ratchet wrench that may prevent jamming during operation, and more particularly to a ratchet wrench that may prevent jamming during operation, wherein when the ratchet wrench jams during operation, the jamming prevention portion may force the pawl member to detach from the ratchet wheel, thereby preventing the ratchet wrench from jamming during operation.

2. Description of the Related Art

A conventional ratchet wrench in accordance with the prior art comprises a wrench body having one end provided with a drive head formed with a receiving chamber, a ratchet wheel rotatably mounted in the receiving chamber of the drive head of the wrench body, a pawl member pivotally mounted in the receiving chamber of the drive head of the wrench body and meshing with the ratchet wheel, and an elastic member mounted in the receiving chamber of the drive head of the wrench body and urged on the pawl member.

In operation, when the drive head of the wrench body is rotated in the operation direction (such as in the counterclockwise direction), the pawl member are closely engaged with the ratchet wheel, so that the workpiece may be rotated counterclockwise by the ratchet wheel. On the contrary, when the drive head of the wrench body is rotated in the reverse direction (such as in the clockwise direction), the ratchet wheel forces the pawl member to compress the elastic member, so that the ratchet wheel are disengaged from the pawl member, and so that the drive head of the wrench body idles.

However, when the ratchet wheel jams with the pawl member during the idling process of the ratchet wrench, the pawl member compresses the elastic member successively, so that the elastic member is easily distorted or worn out.

SUMMARY OF THE INVENTION

The present invention has arisen to mitigate and/or obviate the disadvantage of the conventional ratchet wrench.

The primary objective of the present invention is to provide a ratchet wrench that may prevent jamming during operation, wherein when the pawl member jams with the ratchet wheel, the jamming prevention portion of the pawl member is rested on the wall of the locking recess of the drive head of the wrench body, so that the pawl member is forced to detach from the ratchet wheel, and the ratchet wheel is detached from the drive head of the wrench body, thereby achieving the purpose of preventing the ratchet wrench from jamming during operation.

Another objective of the present invention is to provide a ratchet wrench that may prevent jamming during operation, wherein when the pawl member compresses the elastic member to a determined extent, the jamming prevention portion of the pawl member applies a reaction on the wall of the locking recess of the drive head of the wrench body, so that the pawl member will not compress the elastic member to an excessive extent, thereby preventing from wearing the elastic member.

In accordance with the present invention, there is provided a ratchet wrench that may prevent jamming during operation, comprising a wrench body, a ratchet wheel, a pawl member, and an elastic member, wherein:

the wrench body has one end provided with a drive head, the drive head of the wrench body is formed with a receiving chamber and a locking recess located beside and communicated with the receiving chamber, the locking recess of the drive head of the wrench body has a wall having a first side and a second side;

the ratchet wheel is rotatably mounted in the receiving chamber of the drive head of the wrench body and has an outer wall provided with a plurality of ratchet teeth;

the pawl member is pivotally mounted in the locking recess of the drive head of the wrench, body, and has a first end provided with an urging portion rested on the second side of the wall of the locking recess of the drive head of the wrench body, the pawl member has a first side provided with a plurality of engaging teeth meshing with the ratchet teeth of the ratchet wheel and a second side provided with a protruding jamming prevention portion rested on the wall of the locking recess of the drive head of the wrench body; and the elastic member is mounted in the locking recess of the drive head of the wrench body, and has a first end secured on the second end of the pawl member and a second end secured on the first side of the wall of the locking recess of the drive head of the wrench body.

Further benefits and advantages of the present invention will become apparent after a careful reading of the detailed description with appropriate reference to the accompanying drawings.

DETAILED DESCRIPTION OF THE INVENTION

Figure 1:
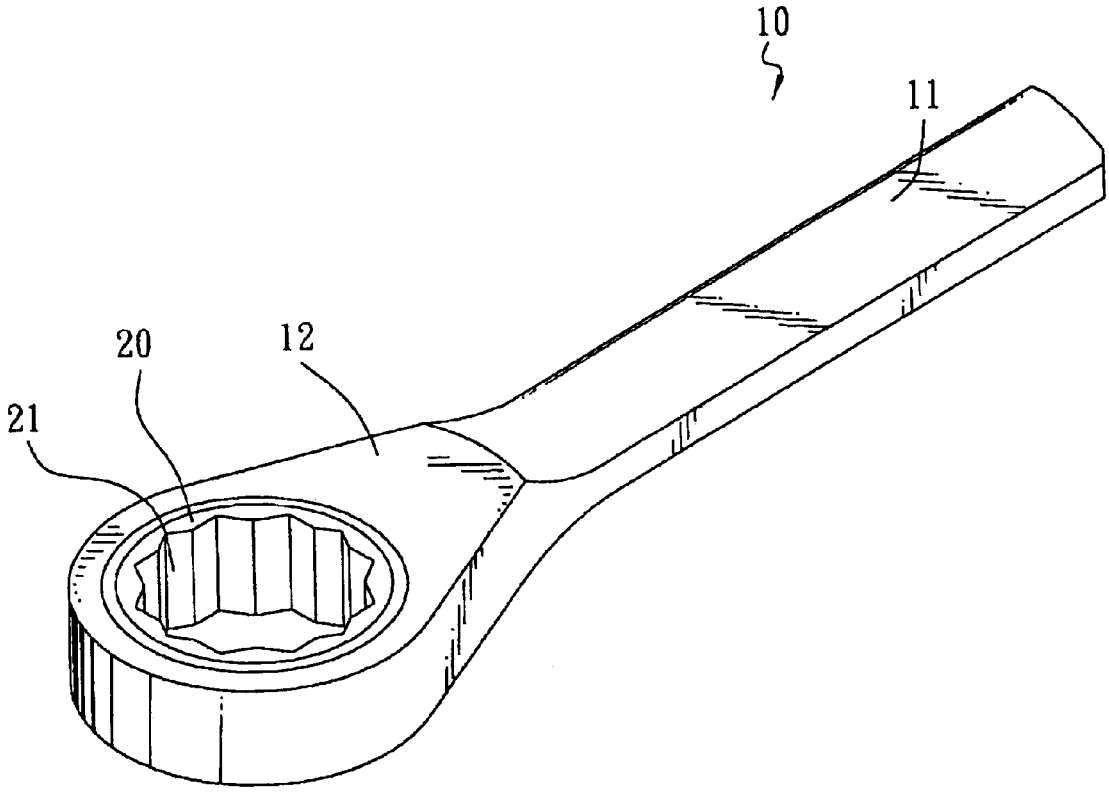
FIG. 1 is a perspective view of a ratchet wrench that may prevent jamming during operation in accordance with a preferred embodiment of the present invention.
Figure 2:
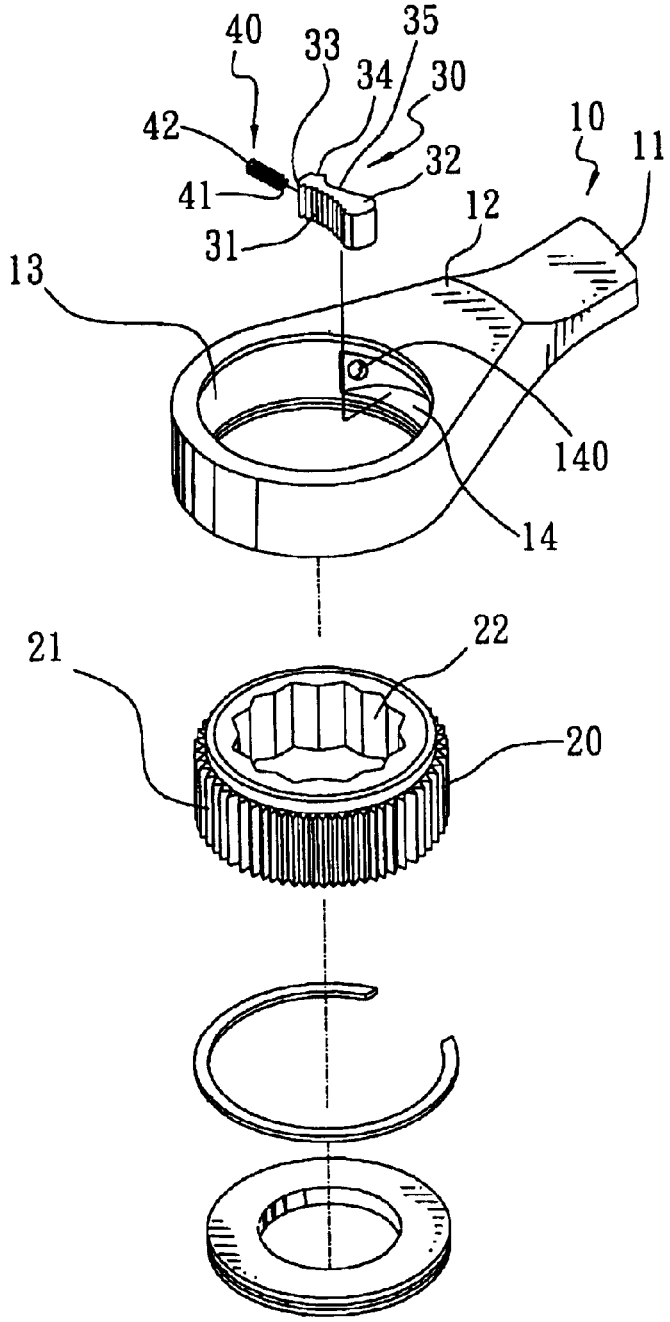
FIG. 2 is an exploded perspective view of the ratchet wrench that may prevent jamming during operation as shown in FIG. 1.
Figure 3:
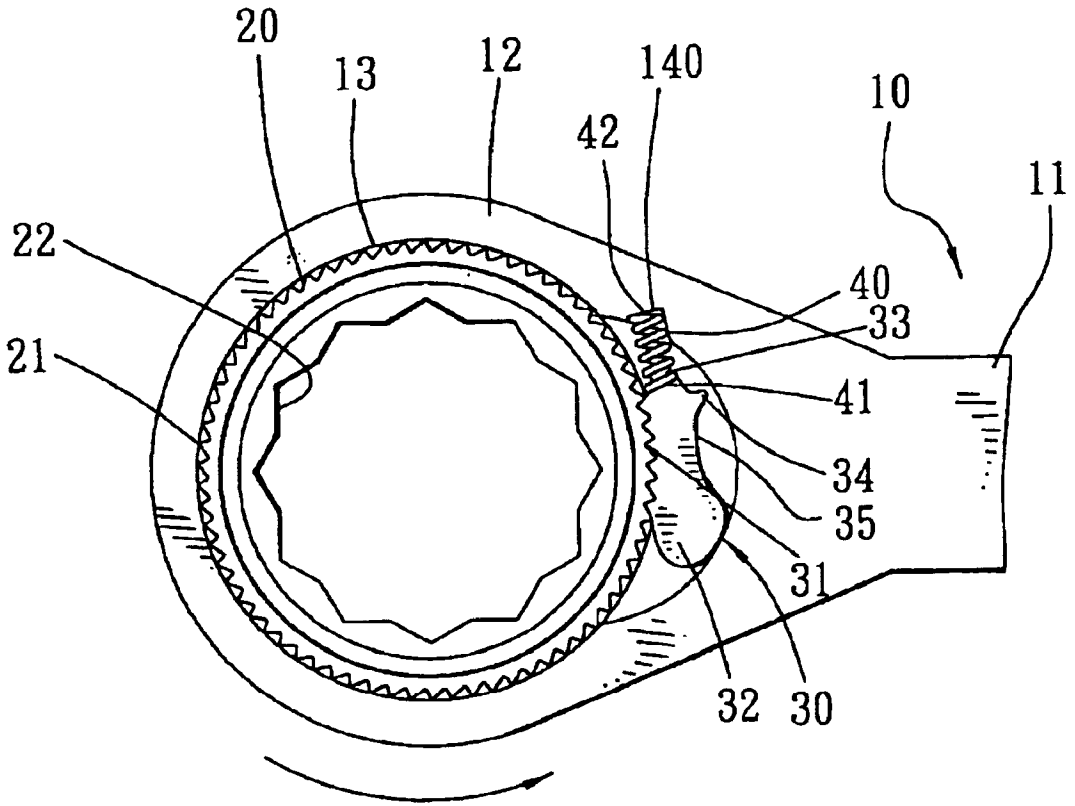
FIG. 3 is a top plan operational view of the ratchet wrench that may prevent jamming during operation as shown in FIG. 1.

Referring to the drawings and initially to FIGS. 1–3, a ratchet wrench 10 that may prevent jamming during operation in accordance with a preferred embodiment of the present invention comprises a wrench body 11, a ratchet wheel 20, a pawl member 30, and an elastic member 40.

The wrench body 11 has one end provided with a drive head 12. The drive head 12 of the wrench body 11 is formed with a receiving chamber 13 and a locking recess 14 located beside and communicated with the receiving chamber 13. The locking recess 14 of the drive head 12 of the wrench body 11 has a wall having a first side provided with a retaining portion 140. Preferably, the retaining portion 140 of the locking recess 14 of the drive head 12 of the wrench body 11 is a retaining hole.

The ratchet wheel 20 is rotatably mounted in the receiving chamber 13 of the drive head 12 of the wrench body 11, and has an outer wall provided with a plurality of ratchet teeth 21 and an inner wall formed with a polygonal drive hole 22 for mounting and driving a workpiece (not shown).

The pawl member 30 is pivotally mounted in the locking recess 14 of the drive head 12 of the wrench body 11, and has a first end provided with an urging portion 32 rested on a second side of the wall of the locking recess 14 of the drive head 12 of the wrench body 11 and a second end provided with a protruding stub 33. Preferably, the urging portion 32 of the pawl member 30 has an arcuate convex shape. The pawl member 30 has a first side provided with a plurality of engaging teeth 31 meshing with the ratchet teeth 21 of the ratchet wheel 20 and a second side 35 provided with a protruding jamming prevention portion 34 located adjacent to the protruding stub 33. Preferably, the second side 35 of the pawl member 30 has an arcuate concave shape.

The elastic member 40 is mounted in the locking recess 14 of the drive head 12 of the wrench body 11, and has a first end 41 secured on the protruding stub 33 of the pawl member 30 and a second end 42 retained in the retaining portion 140 of the locking recess 14 of the drive head 12 of the wrench body 11.

In operation, referring to FIG. 3, the pawl member 30 is urged by the elastic member 40, so that the urging portion 32 of the pawl member 30 is rested on the second side of the wall of the locking recess 14 of the drive head 12 of the wrench body 11, and the engaging teeth 31 of the pawl member 30 mesh with the ratchet teeth 21 of the ratchet wheel 20. At this time, the ratchet wheel 20 is locked by the pawl member 30, so that the ratchet wheel 20 cannot be rotated freely. When the drive head 12 of the wrench body 11 is rotated counterclockwise to apply a torque on the workpiece, the applied torque of the workpiece is transmitted through the ratchet wheel 20 to the pawl member 30. At this time, the urging portion 32 of the pawl member 30 is rested on the second side of the wall of the locking recess 14 of the drive head 12 of the wrench body 11 to absorb the applied torque and to apply a reaction on the ratchet wheel 20, so that the engaging teeth 31 of the pawl member 30 are closely engaged with the ratchet teeth 21 of the ratchet wheel 20, and the workpiece may be rotated counterclockwise by the ratchet wheel 20.

Figure 4:
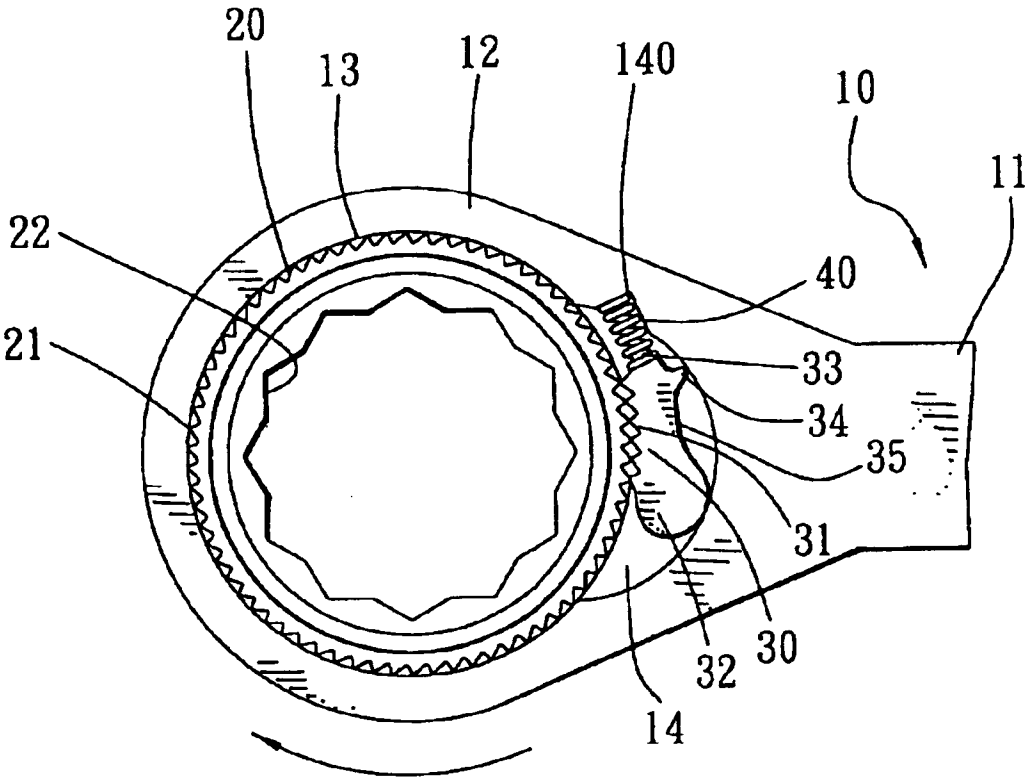
FIG. 4 is a top plan operational view of the ratchet wrench that may prevent jamming during operation as shown in FIG. 1.

As shown in FIG. 4, when the drive head 12 of the wrench body 11 is rotated clockwise, the ratchet wheel 20, the applied torque of the workpiece is transmitted through the ratchet wheel 20 to the pawl member 30, so that the ratchet wheel 20 forces the pawl member 30 to move in the locking recess 14 of the drive head 12 of the wrench body 11 toward the elastic member 40, thereby compressing the elastic member 40, so that the ratchet teeth 21 of the ratchet wheel 20 are disengaged from the engaging teeth 31 of the pawl member 30. Thus, the ratchet wheel 20 is unlocked from the pawl member 30 and can be rotated freely, so that the drive head 12 of the wrench body 11 idles.

Figure 5:
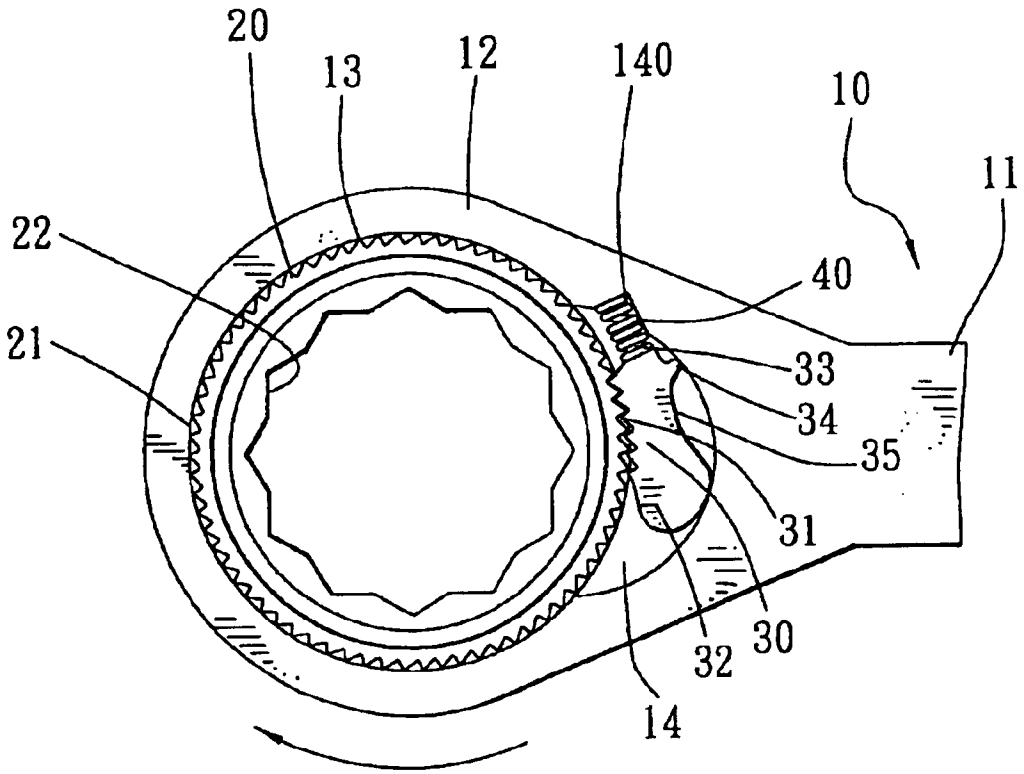
FIG. 5 is a schematic operational view of the ratchet wrench that may prevent jamming during operation as shown in FIG. 4.

As shown in FIG. 5, when the pawl member 30 jams with the ratchet wheel 20 without detachment and the drive head 12 of the wrench body 11 is driven and rotated successively, the ratchet wheel 20 forces the pawl member 30 to move in the locking recess 14 of the drive head 12 of the wrench body 11 to compress the elastic member 40. At this time, the jamming prevention portion 34 of the pawl member 30 is rested on the wall of the locking recess 14 of the drive head 12 of the wrench body 11, so that the wall of the locking recess 14 of the drive head 12 of the wrench body 11 may apply a reaction to the pawl member 30, thereby stopping movement of the pawl member 30. Thus, the pawl member 30 cannot be moved any more. When the ratchet wheel 20 is rotated successively, the pawl member 30 is forced to detach from the ratchet wheel 20, so that the ratchet wrench 10 is returned to the normal state and may be operated normally. In addition, when the pawl member 30 is forced to detach from the ratchet wheel 20, the pawl member 30 will not compress the elastic member 40 any more, thereby preventing from wearing the elastic member 40.

Accordingly, the ratchet wrench 10 that may prevent jamming in accordance with the preferred embodiment of the present invention has the following advantages.

1. When the pawl member 30 jams with the ratchet wheel 20, the jamming prevention portion 34 of the pawl member 30 is rested on the wall of the locking recess 14 of the drive head 12 of the wrench body 11, so that the pawl member 30 is forced to detach from the ratchet wheel 20, and the ratchet wheel 20 is detached from the drive head 12 of the wrench body 11, thereby achieving the purpose of preventing the ratchet wrench 10 from jamming during operation.

2. When the pawl member 30 compresses the elastic member 40 to a determined extent, the jamming prevention portion 34 of the pawl member 30 applies a reaction on the wall of the locking recess 14 of the drive head 12 of the wrench body 11, so that the pawl member 30 will not compress the elastic member 40 to an excessive extent, thereby preventing from wearing the elastic member 40.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising a wrench body, a ratchet wheel, a pawl member, and an elastic member, wherein:

the wrench body has one end provided with a drive head, the drive head of the wrench body having a receiving chamber formed therein and a locking recess formed adjacent to the receiving chamber and in open communication therewith, the locking recess of the drive head of the wrench body being formed with an arcuate wall having a first end and a second end, the first end of the locking recess wall having a retaining hole formed therein;

the ratchet wheel is rotatably mounted in the receiving chamber of the drive head of the wrench body and has an outer wall provided with a plurality of ratchet teeth;

the pawl member is displaceably disposed in the locking recess of the drive head of the wrench body, the pawl member having opposing first and second sides extending between first and second ends thereof, the second side having an urging portion formed thereon adjacent the first end of the pawl member and contacting the second end of the wall of the locking recess of the drive head of the wrench body, the pawl member having a plurality of engaging teeth formed on the first side thereof and meshing with the ratchet teeth of the ratchet wheel for limiting the ratchet wheel to rotation in a single direction relative to the wrench body, the pawl member being formed with a protruding stub extending from the second end thereof and a protruding jamming prevention portion extending from the second side of the pawl member adjacent the second end thereof; and the elastic member is mounted in the locking recess of the drive head of the wrench body, the elastic member having a first end secured on the protruding stub of the pawl member and a second end secured within the retaining hole, wherein the protruding jamming prevention portion contacts the locking recess wall when the ratchet wheel rotates in the single direction to limit displacement of the pawl member toward the first end of the locking recess and thereby prevent jamming of the pawl member with the ratchet wheel.

* * * * *